US008622010B2

(12) United States Patent
Gray et al.

(10) Patent No.: US 8,622,010 B2
(45) Date of Patent: Jan. 7, 2014

(54) SEACOCK CLOSING SYSTEM

(76) Inventors: Seth Joseph Gray, Cranberry Isles, ME (US); Edward Joseph Gray, Cranberry Isles, ME (US)

( * ) Notice: Subject to any disclaimer, the term of this patent is extended or adjusted under 35 U.S.C. 154(b) by 213 days.

(21) Appl. No.: 13/373,214

(22) Filed: Nov. 8, 2011

(65) Prior Publication Data

US 2013/0112902 A1 May 9, 2013

(51) Int. Cl.
*B63B 13/00* (2006.01)
*F16K 1/34* (2006.01)

(52) U.S. Cl.
USPC ..... 114/198; 251/210; 251/304

(58) Field of Classification Search
USPC ..... 114/198; 251/210, 283, 304
See application file for complete search history.

(56) References Cited

U.S. PATENT DOCUMENTS

| | | | | |
|---|---|---|---|---|
| 4,697,535 | A * | 10/1987 | Wileman, III | 114/183 R |
| 5,947,047 | A * | 9/1999 | Sigler | 114/198 |
| 6,343,965 | B1 | 2/2002 | Biggs et al. | |
| 6,786,782 | B1 * | 9/2004 | Robinson | 440/88 C |
| 2005/0167628 | A1 * | 8/2005 | Gross | 251/285 |
| 2010/0108931 | A1 * | 5/2010 | Dalluge et al. | 251/305 |
| 2011/0278307 | A1 * | 11/2011 | Muscatell | 220/592.2 |

* cited by examiner

*Primary Examiner* — Stephen Avila
(74) *Attorney, Agent, or Firm* — Robert K. Tendler

(57) ABSTRACT

A pneumatic seacock retrofit is provided for convenient closing of all or a portion of the seacocks, whether as a matter of every day convenience or for use in an emergency, in which all of the vessel's seacocks can be pneumatically closed at the same time, leaving the possibility of selectively overriding seacock closure, with all control valves operating to provide a momentary pulse of air to the rotary actuators and then return to a neutral position, leaving the actuators free for further control. Moreover, an operator is free to manually close a valve in the event that the pneumatic system fails.

21 Claims, 5 Drawing Sheets

SEACOCK CLOSING SYSTEM

FIELD OF THE INVENTION

This invention relates to a vessel sinking protection system and more particularly to a convenient pneumatic failsafe system for closing seacocks.

BACKGROUND OF THE INVENTION

A major cause of vessel sinking is the failure to close seacocks when the vessel is at anchor or docked. Recent insurance industry estimates report that for every boat that sinks at sea four boats sink while safely moored at their slips. Of those that are safely moored at their slips half of these sinkings are due to seacock failure. Thus for every boat that sinks at sea there are at least two that sink because their seacocks fail while they were sitting at the dock.

The failure of seacocks happens for two main reasons; a leak in the seacock or a leak in the line or hose from the seacock to the device or unit that the seacock is coupled to. Thus, for instance, a hose that is coupled to a seacock and is run to a device or a unit may come off of the seacock due to improper double-clamping. Secondly, even if the hose to the seacock is intact, if the hose lets loose from the device or unit to which it is attached and then extends down below the water line the vessel will fill with water and sink.

A major problem with manually operated seacocks is that they are very inaccessible and must often times be closed with a wrench that may be temporarily lost. Thus, in an emergency there may be no manual way to close up all the seacocks to prevent flooding, Moreover, one may not want to close all of the seacocks involved if it can be ascertained which seacock is responsible for the vessel flooding.

An electric solenoid system exists to close seacocks. However electricity may not be available as a vessel floods due to battery failure. Therefore these systems are ineffective precisely at the time when they should be effective to prevent the sinking of the vessel during an emergency.

It will be appreciated that a seacock is any valve that is below the water line and is utilized for instance to admit raw sea water into such devices as an engine, a refrigeration unit or a water purification unit, or for shooting out waste.

As will be appreciated, the operator of the vessel is supposed to close all of the seacocks when the vessel is moored, because if a hose pops off and if it is below the water line, sea water floods the boat, filling it quickly and the vessel sinks.

While relatively large ocean going vessels have hydraulically controlled sea water valves, due to the fact it takes so much force to open these large valves, smaller boats are left to manual operation of their seacocks.

While operators of smaller boats want to be able to close the seacock or valve causing the trouble, they may also want to be able to leave other valves open, for instance to leave the raw water intake seacock for the engine open. Moreover, it may be desirable to have a seacock open if the faulty seacock or line is to a non-critical unit such as a head. It is thus important to be able to shut off the affected seacock without closing an unaffected seacock. Thus, it is desirable to be able to leave selected seacocks open, especially the seacock that is utilized to provide for the ingest of water to cool an engine, if the engine seacock is functioning correctly.

On the other hand, prior to ascertaining what seacocks and lines have failed, one would very much like to have a convenient and fail safe system for closing all of the seacocks to allow the operator to figure out which seacock or associated line is leaking or has failed. Once the leaking seacock has been diagnosed, it is desirable to have the operator can keep open the seacocks that are working properly.

For instance, if one is offshore fishing and one has discovered that a seacock is leaking, one could still operate unaffected equipment while simply keeping the affected seacock closed, allowing the boat to reach port where the affected seacock and associated line can be repaired.

Additionally, in terms of manual operation of seacocks or thru-hull valves, often-times manual operation requires a lever that is six inches long. There must thus be at least 6 inches of clearance around the seacock in order to be able to manually activate the seacock valve. Since these seacocks are in inaccessible spaces, it is either inconvenient or near impossible to be able to manually close a seacock. Moreover, depending on the seacock size and style it usually takes about 35 pounds of pressure to open and close a seacock, which means it takes 70 pounds of force that one has to exert on the seacock valve in order to open or close it. For many seacocks they are in a place where one cannot physically exert that much force on the valve.

Prior systems have been utilized to close off water inlet valves such as illustrated in U.S. Pat. Nos. 6,786,782; 5,947,047; 6,343,965; and 4,697,535. It is apparent from the above that there are no retrofit pneumatically operated systems to close all seacocks either for convenience or in an emergency.

Those systems requiring electricity are shown in U.S. Pat. Nos. 5,947,047 and 4,697,535, both of which operate with electrical power to close valves. It is important not to have electrically operated seacocks because the seacocks are located in a very damp and corrosive environment. It is noted that electrical systems generally do not last indefinitely in such environments. As mentioned above, when the sea water gets above battery level, the entire electrical system shorts out and one has no electricity aboard.

Referring now to U.S. Pat. No. 6,786,782, it will be appreciated that pneumatic valve actuation is described. However, it can be seen that the pneumatic valve actuator is placed on top of the seacock, meaning that an additional piece of apparatus must be added in series with the seacock to be able to shut off the water flow. A pneumatically actuated valve in series with the seacock is both cumbersome because it adds additional structure on top of the seacock, and is also counterproductive in that a failure can occur between the seacock and the pneumatically actuated valve. As a result, its use with existing seacocks is problematic.

In order to close a particular valve utilizing this patent, positive pressure must be maintained in order to keep the valve closed. Thus, for instance, in the piston arrangement shown, since it is spring loaded to keep the valve open, pressure must be continuously applied to the piston in order to keep the valve shut. This requires a constant source of pressure and a large reservoir.

Further and as will be appreciated, U.S. Pat. No. 6,343,965 relates to a pneumatically-actuated marine engine water drain system in which the water drains into the bilge of a boat or overboard. However, as can be seen, here there is no seacock.

Most importantly, not shown in the above-described art is the ability to close all of the seacocks in an emergency situation in which pneumatic closure overrides the actuation of any of the open seacocks. Moreover, nowhere is shown the ability to selectively open unaffected seacocks so that once the emergency situation has been addressed through the closing of all the seacocks, non-critical seacocks can be reopened for normal operation.

SUMMARY OF INVENTION

In order to provide a convenient way of controlling seacocks and/or for vessel sinking protection, a failsafe system is provided for closing all of the seacocks in a vessel and thereafter selectively opening unaffected seacocks. In the subject system a pneumatically-driven seacock valve stem actuator is provided for each seacock in which in one embodiment an adapter is fitted over the manually actuated valve stem which protrudes from the side of the seacock housing, with the adapter being powered by a pneumatic rotary actuator, in one embodiment a rack and pinion rotary actuation system to pneumatically move the seacock from an open position to a closed position and vice versa.

While the above applies to original seacock installations, a retrofit package may be used to retrofit existing seacocks with pneumatic actuation. Moreover, in one embodiment the normal seacock handle remains in place for manual operation.

In one embodiment, the adapter is bolted to the flange of the seacock through a mounting bracket or collar that saddles the seacock and positions the rotary actuator over the flange of the seacock. This collar piggybacks on the bolts that anchor the seacock such that it is unnecessary to modify the seacock for retrofitting.

The reason that this retrofit is successful is that all seacocks of either ball type or tapered cone type have a valve stem to control the position of the internal system.

The aforementioned adapter fits over this rod and engages the valve stem. As a result, the retrofit involves removing the handle and slipping on the adapter so that it only contacts the flats and not the threads. Thus there is no damage to the seacock.

Note that the adapter is kept tight against the seacock by the design of the mounting collar which pulls the rotary actuator tight against the seacock. The adapter contacts the bolt in a loose fit such that the adapter can float slightly about an eighth of an inch. As a result, there is no squeezing force on the ball of the seacock.

The pneumatic actuator in one embodiment utilizes the aforementioned rack and pinion rotator that can operate at any pressure from for instance 35 PSI to 120 PSI. For the application involved, one chooses the lowest pressure specified by the manufacturer that is necessary for rotating the seacock valve. Seacock manufacturers routinely specify a baseline torque for moving the valve so that the pneumatic pressure can be appropriately set. Note that the rotary actuator torque is linear with pressure so that the correct pressure for operating the valve can be easily calculated.

Moreover, in one embodiment, the valve is not over rotated when the stops are taken off with the removal of the handle. Rather, internal stops within the rack and pinion rotator provide for the stops necessary to limit the valve rotation for instance between 0° to 90°. It is noted that rotary actuators are factory set from 0 degrees to 90 degrees, but can also be set from negative 10° to 100°. Since most seacocks operate in the 0 to 90 degree range, setting the stops within the rotary actuator is not required.

Moreover, in order to prevent vibration damage to the seacock valve, a needle valve is positioned between the reservoir and the rotary actuator such that the actuator does not experience the full volume of air when a control valve is opened to supply the air to the rotary actuator.

The rack and pinion rotary actuator is chosen because of its compactness so that it may be easily positioned in hard-to-reach areas which are usually inaccessible by the vessel's operator. Note seacocks exist where there are exhaust lines or intake lines going over the seacocks, or the seacock may be underneath an engine or underneath hatches. Thus most seacocks are relatively inaccessible.

The rotary actuators chosen are extremely compact and will fit in the places where one could extend one's arm to get to a seacock and move the valve stem.

While there are many types of other actuators that could have been used, impact wrench type actuators are not practical because of their torque output. This is because of the large volume of air required and because the air supply must continuously available. Moreover, there are no stops in impact wrench actuators so they must be operated without knowing if the valve is already closed or open.

Other designs include a two air piston design known as a kinematic device which is likewise impractical because of the amount of space utilized and also because the large volume of air requires an exceptionally large reservoir.

As part of the subject invention the system for preventing vessel sinking includes an air reservoir and a number of control valves interposed between the reservoir and the rotary actuators, each of which can individually open or close a seacock by momentarily applying a pulse of air to a port on the rotary actuator. Once the initial pulse of air is delivered to the rotary actuator the control valve returns to a neutral position after which no pneumatic pressure is applied to the rotary actuator.

This has two consequences. First, if one seeks to manually close or open a particular valve one can do so because there is no internal pressure operating on the rotary actuator that would limit seacock valve rotation, all the ports to the rotary actuator being exhausted to the ambient. Secondly, when one utilizes an emergency shutoff valve coupled to the reservoir, the valve connections or circuits are in parallel to those associated with other control valves such that regardless of the position of a seacock valve, when the emergency valve is moved to close all seacocks, a pulse of air is delivered through the actuator's control valve to the appropriate port on each rotary actuator to close the associated seacock valve should it be open. The emergency control valve is also spring loaded back to a neutral position so that it only provides a momentary pulse of air to all of the seacock valve actuators. Thereafter, there is no back pressure on the rotary actuator. This means that this actuator can be again controlled by its control valve regardless of any prior emergency closures.

In one embodiment, a control panel is located between the reservoir and the control valves, with this panel being supplied with an air gauge to indicate the condition of the reservoir.

It is noted that the subject assembly is retrofittable to any valve that has a valve stem extending from the seacock body. Thus any seacock that has a handle can be retrofitted with the subject apparatus. Note that the bolts that hold the seacock in place are used to mount the actuator. As a result, the rotary actuator does not create any undue pressure on the valve itself. Thus, unless one exerts an extraordinary amount of torque one cannot snap off the valve stem by installing the actuator and adapter onto the flange because the flange takes all the load.

Note also that the aforementioned adapter does not apply any force to the valve that is not designed to take. Nor does it affect the friction that the valve was designed with to keep the valve open.

Further, it is noted that by providing the subject retrofit unit one is preventing the ingress of water at its lowest point, thereby eliminating the necessity of providing additional apparatus above this point to close off the flow of water.

Finally, when one closes all of the valves in an emergency shutoff situation it is important to prevent engine operation once the seacock to the engine closed. For gasoline engines it is very common that vessels have a neutral safety switch so that one cannot start up the engine when the safety switch is engaged. In one embodiment there is either an electrical or mechanical linkage to this safety switch from the associated seacock. Also, gasoline engines have switches which cut off the engine if it overheats.

As to diesel engines that do not require electricity for operation, the seacock that supplies the raw sea water intake to the engine may be mechanically linked to a mechanical fuel shutoff for the engine that prevents the engine from running when the associated seacock has been turned off.

Regardless it is part of the subject invention to provide a fail safe system for turning off an engine when its associated seacock has been closed.

In one operative embodiment with a reservoir having a three gallon capacity, seacocks have been opened and closed for a period of 15 cycles without having to recharge the reservoir. This means that in an emergency situation there will be sufficient air supply to be able to close all of the seacocks, while at the same time providing sufficient reserve for normal valve operation.

In summary, a pneumatic seacock closing system is provided in which seacocks can be conveniently closed or in which vessel sinking can be prevented by the ability to pneumatically close all of the vessel's seacocks while at the same time leaving the possibility of selectively overriding seacock closure, with all control valves operating to provide a momentary pulse of air to the rotary actuators and then return to a neutral position, leaving the actuators free for further control. In one embodiment, the subject system is provided in a seacock retrofit package.

BRIEF DESCRIPTION OF THE DRAWINGS

These and other features of the subject invention will be better understood in connection with the Detailed Description, in conjunction with the Drawings, of which.

DETAILED DESCRIPTION

Figure 1:
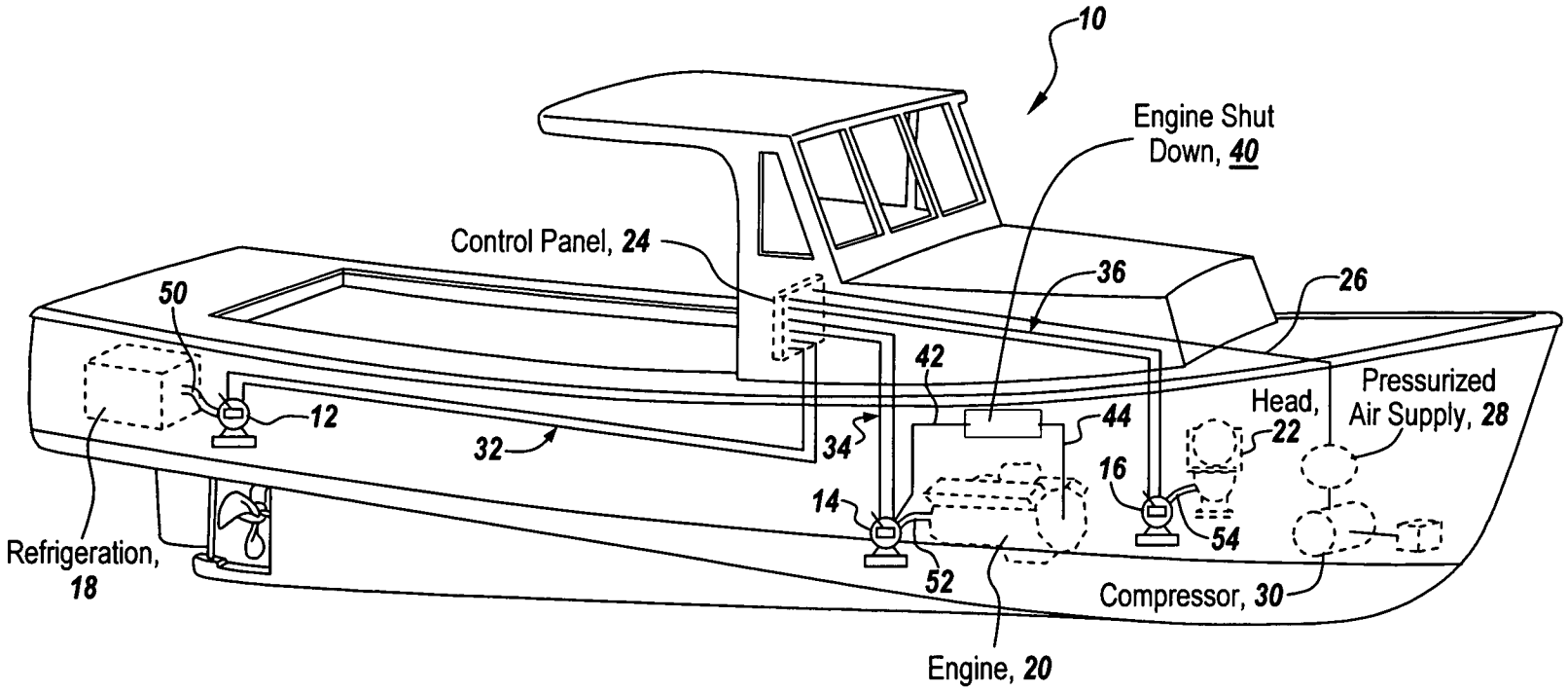
FIG. 1 is a diagrammatic illustration of a vessel with a vessel sinking protection system that includes a pneumatically actuated series of seacocks under the control of a control panel.

As illustrated in FIG. 1, vessel 10, herein illustrated as a lobster boat, is shown provided with a number of seacocks 12, 14 and 16 which admit sea water respectively to a refrigeration unit 18, an engine 20 and a head 22. These seacocks are of a conventional variety which should be closed when the vessel is moored or at a dock so that inadvertent failure of the hoses from the seacocks to the indicated apparatus will not result in the sinking of the vessel.

In order to provide for the subject seacock closing system a control panel 24 is utilized to control the pressure over line 26 from a pressurized air supply 28 coupled to compressor 30.

As will be described, various control valve levers or switches may be utilized to close all of the seacocks in a value closing operation that bypasses or overrides any previous condition of a seacock and its associated actuator.

While the actuators will be described in FIGS. 2, 3 and 4, pairs of air supply lines from control panel 24 illustrated at 32, 34 and 36 control these actuators.

It is noted that the pneumatic actuators for each these seacocks are coupled to an air supply by these pairs of lines, with an air pulse on one line opening the associated seacock through the actuation of the associated rotary actuator, and with a pulse on the other of the two lines closing the associated seacock.

Also shown is an engine shutdown module 40 which is mechanically linked to seacock 14 as illustrated at 42. When seacock 14 is closed, module 40 shuts off the fuel supply to engine 20 as illustrated by dotted line 44. In this way when seacock 14 is closed it is impossible to run engine 20 which would otherwise be damaged with the cutoff of cooling water.

While a mechanical linkage is shown for diesel engine shutdown, conventional internal combustion engines may be shut down by solenoids for cutting off the power to the engine.

The cause of vessel sinking may be a failure of the hose or conduit between the associated seacock and the unit to which sea water is applied or from which waste is to be jettisoned. Here it can be seen that seacock 12 is coupled to refrigeration unit 18 by hose or conduit 50, whereas seacock 14 is connected to engine 20 by hose or conduit 52. Likewise a hose 54 connects the outflow of head 22 to seacock 16.

It will appreciated that if there is any failure of these hoses, either due to leakage or due to a hose slipping off an associated nipple either at the seacock or at the device to which it is attached, downflooding of the vessel can occur, sometimes in a rapid fashion.

As will be discussed, a retrofittable system is provided to be able to retrofit each of the seacocks with an actuator which is pneumatically driven to be able to close or open all seacocks, and to be able to selectively control seacock actuation based on the position of the control levers on control panel 24.

In operation, when an operator wishes to leave his or her vessel, the operator actuates an emergency "all close" valve lever to close all seacocks. Thus, when an operator leaves a vessel, he or she can be assured that the vessel is secure against leakage, at least from the seacocks.

When the operator comes aboard, he may wish to open all of the seacocks and this can be accomplished by the same emergency lever so that whatever the condition any of the seacocks in, they will all be turned to an open position.

Because of the parallel series connection of the emergency control valve to the individual control valves that supply momentary air pressure pulses to the actuators of the seacocks, an operator of the vessel can override any previous condition of the emergency valve by applying air pressure to the appropriate opening or closing line for an actuator.

This gives the operator of the vessel a procedure by which he can immediately close all of the seacocks in his vessel as for instance when an emergency situation arises. After closing of all of the seacocks, the operator can investigate the cause of the leak and can selectively open unaffected seacocks.

If in an emergency situation the operator closes all of the seacocks, in one embodiment the seacock associated with the engine is arranged to turn off the engine, be it a diesel engine or a conventional gas engine. Thus when the seacock associated with the engine is closed the engine will not overheat due to a lack of cooling water.

Alternatively, assuming the seacock associated with the engine is not compromised, the sea engine seacock can be re-opened simply by applying an appropriate pulse of air to the associated actuator.

Figure 2:
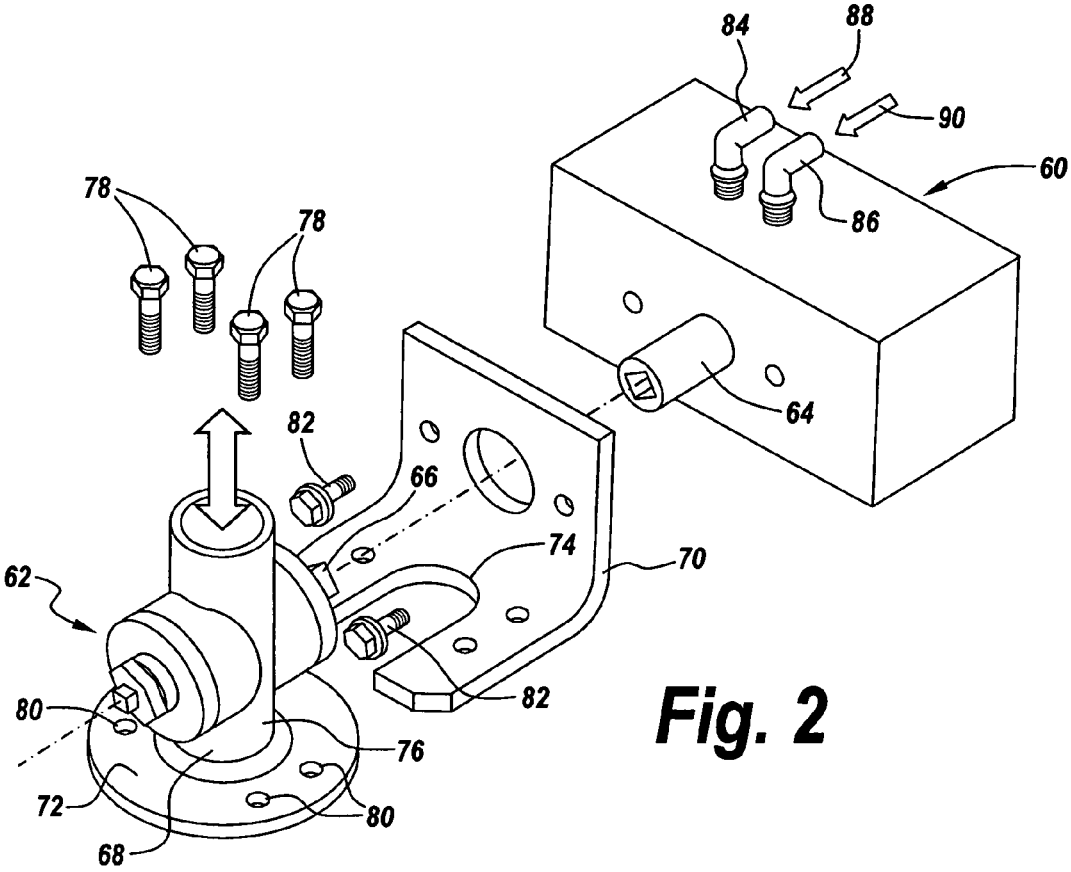
FIG. 2 is an exploded view of a rotary actuator retrofit to a standard seacock to rotate the seacock valve stem through pneumatic actuation of the rotary actuator.

Referring to FIG. 2, as part of the subject invention, the pneumatic actuator assembly, here illustrated at 60, may be rapidly retrofit to a seacock 62 through the use of an adaptor 64 that slips over a shaft 66 extending from housing 68 of seacock 62. Adaptor 64 is the only piece of apparatus that is required to be specially fit, with the adaptor slipping over the rotary shaft of the actuator and also the valve stem bolt or shaft 66 from the seacock.

Actuator 60 is mounted to seacock 62 through the use of a collar or frame 70 that is bolted to flange 72 of seacock 62, with the collar or flange 70 having a "u" shaped cut out 74 adapted to fit around the cylindrical seacock outflow pipe 76 when the collar or flange 70 is bolted to flange 72 by bolts 78 that are screwed into threaded orifices 80.

Actuator 60 is mounted to flange or collar 70 through bolts 82 such that the mounting of the actuator as a retrofit package to a seacock is simple.

As will be seen, actuator 60 is provided with a pair of inlet ports 84 and 86, with port 84 being provided with a pulse of air indicated by arrow 88 to rotate adapter 64 for closing the associated seacock, and with port 86 provided with a pulse of air 90 to rotate adapter 64 in the opposite direction to open the associated seacock.

Figure 3:
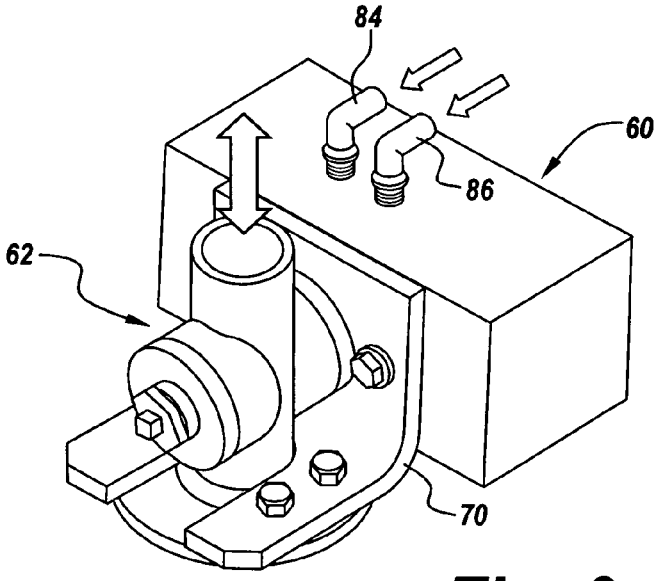
FIG. 3 is a diagrammatic illustration of the actuator FIG. 2 assembled to a seacock and utilizing a collar bolted the seacock flange.

Referring to FIG. 3 the assembled retrofit package is shown in which actuator 60 is bolted or secured to seacock 62 through the utilization of the aforementioned flange or collar 70 that is bolted to the two units.

Figure 4A:
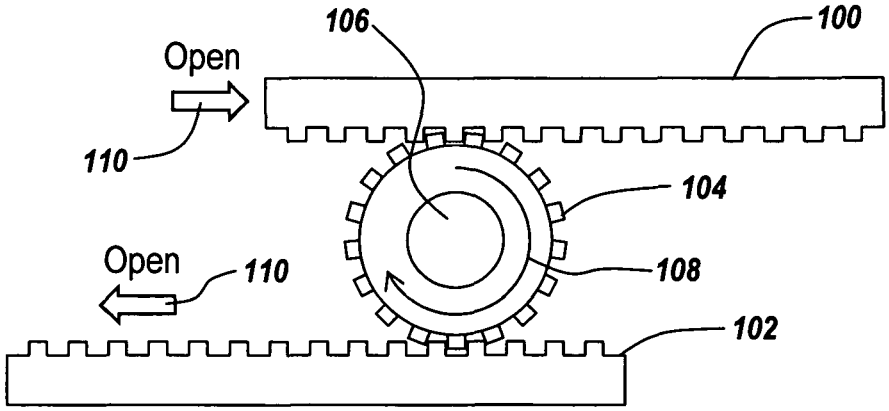
FIGS. 4*a* and 4*b* illustrate the rack and pinion mechanism for rotating the rotary actuators of FIGS. 2 and 3, showing opposite movement of the upper and lower racks to open or close the associate seacock valve.
Figure 4B:
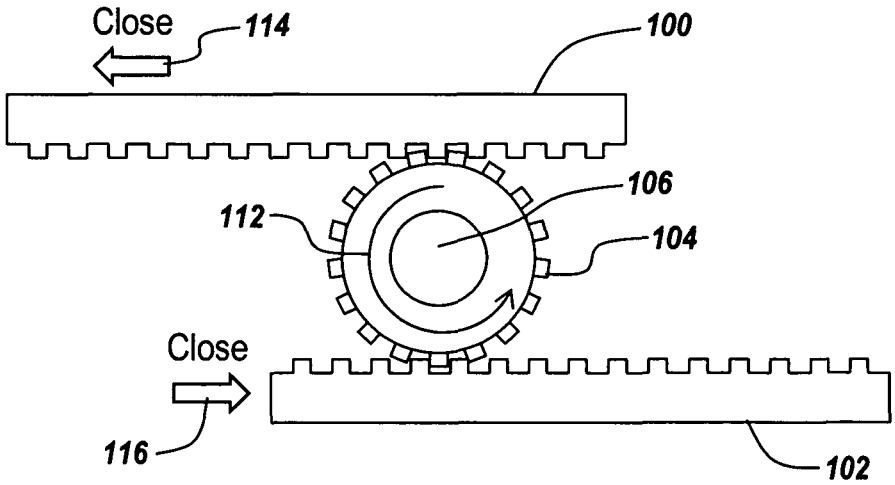

Referring to FIGS. 4*a* and 4*b*, actuator 60 of FIGS. 2 and 3 may include a rack and pinion arrangement in which rack elements 100 and 102 cooperate with a pinion 104 that is utilized to rotate a shaft 106 in the direction of arrow 108 when the racks are moved in the direction of arrows 110 to open the associated seacock through the rotation of shaft 106. As seen in FIG. 4*b* when it is desired to close the associated seacock, pinion 104 is rotated in the direction of arrow 112 through the action of the associated rack elements 100 and 102 which are moved in opposed directions as shown by arrows 114 and 116.

As mentioned hereinbefore, utilization of a rack and pinion type of actuator provides the utmost in simplicity for seacock valve turning in a minimum amount of space and with a minimum amount of mechanical complexity.

Such an actuator is commercially available as model ECV63DA from Rotex Controls in which stops are provided at the factory such that shaft 106 in FIGS. 4*a* and 4*b* can be rotated only through 90°, for instance from 0° to 90°, thereby eliminating the need for valve stem stops.

As will be appreciated, in order to retrofit the actuator to the seacock, it is often times necessary to remove the handle from the seacock, with the handle in most instances being provided with mechanical stops. However, by utilizing internal stops in the actuator, the seacock valve may be rotated, but not over rotated.

Figure 5:
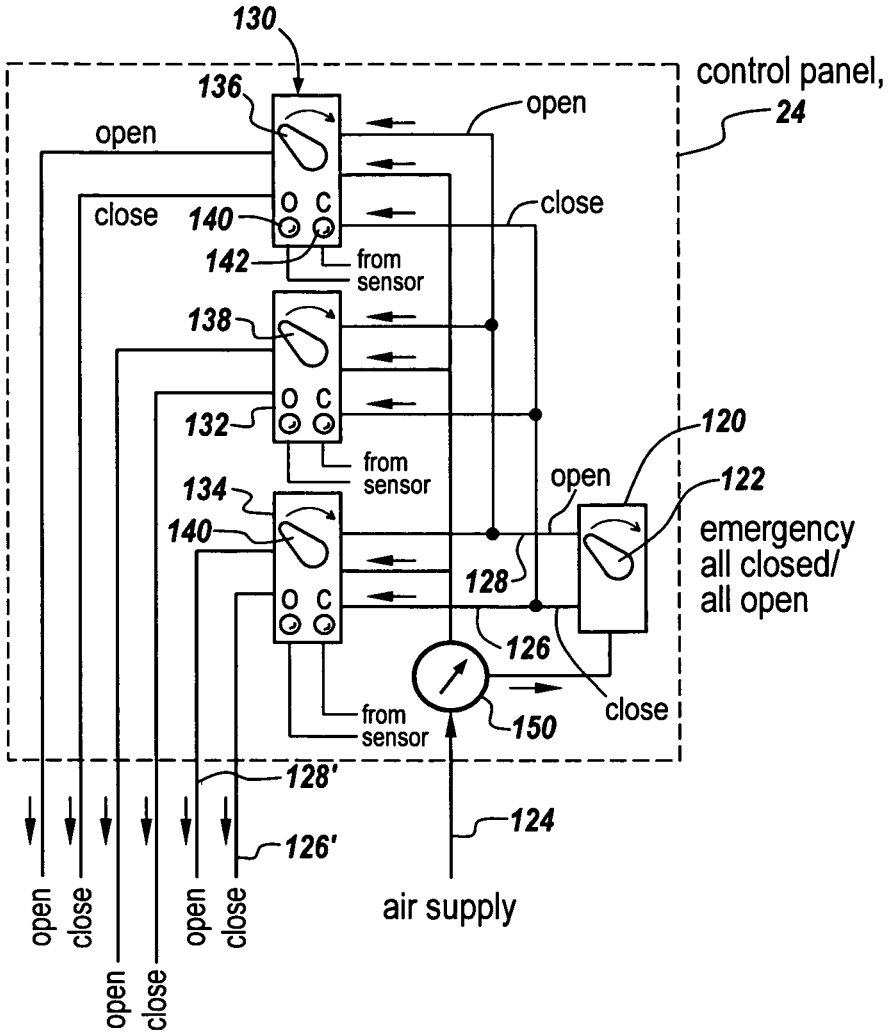
FIG. 5 is a schematic diagrammatic of the valves in the control panel of FIG. 1, showing an emergency all close/all open valve connected in parallel to valves controlling associated seacocks, illustrating the airflow for controlling the rotary actuators for each of the seacocks, with the emergency all close/all open valve overriding the action of the individual control valves for the seacocks; and, FIG. 6 is a schematic and diagrammatic illustration of the parallel connection of the emergency all close/all open valve to the individual control valves coupled to the associated actuators.

Referring now to FIG. 5, control panel 24 of FIG. 1 is illustrated, in which the control panel houses an emergency all close/all open valve 120 that is provided with a handle or toggle lever 122 which when rotated causes air from an air line 124 to be supplied either to a "valve closed" line 126 or a "valve open" line 128, with these lines being coupled in parallel to individual seacock control valves 130, 132 and 134. Regardless of the position of the levers associated with valves 130, 132 and 134, namely levers 136, 138 and 140, pressure on lines 126 and 128 is passed through these valves over lines for instance 126' and 128' to close and open the associated seacock through its actuator.

The reason that the emergency valve 122 can override the action of the valves 130, 132 and 134 is because all of the valves in the subject invention are momentary actuation valves in which the opening or closing movement of a lever is only momentary, with the lever being returned to a neutral position by spring biasing or other means.

This means that a pulse of air over a line is momentarily delivered to an actuator after which there is no residual pressure in any of the lines going to the respective actuators.

Moreover, because of the rack and pinion arrangement, once the racks are moved to a position, they stay there, and no additional air pressure is necessary to maintain their position.

As a corollary to the fact that there is no pressure on the actuators when the control valves are in their normal neutral position is the fact that it is easy to manually control any seacock to close or open it's valve because there is no back pressure from the system, once the system has set the valves in an open or closed position.

As can be seen in FIG. 5 the condition of a seacock is shown by an indicator 140 or 142, indicating respectively an open seacock or a closed seacock. Thus the operator of the vessel can easily ascertain the condition of each of the seacocks. Note, each of the control valves is provided with such an indicator, with the indicators coupled to seacock condition sensors at the associated seacock.

Finally, as illustrated at 150 the pressure delivered to the control panel can be continuously monitored such that if the pressure drops below some predetermined level compressor 30 of FIG. 1 can be utilized to recharge pressurized air supply 28 to bring the system up to normal operating pressure.

In one embodiment a pressurized air tank is on the order of 15 gallons pressurized at 120 psi providing a pressure of 45 psi which can control for instance up to 5 actuators cycling 15 times before recharging.

Figure 6:
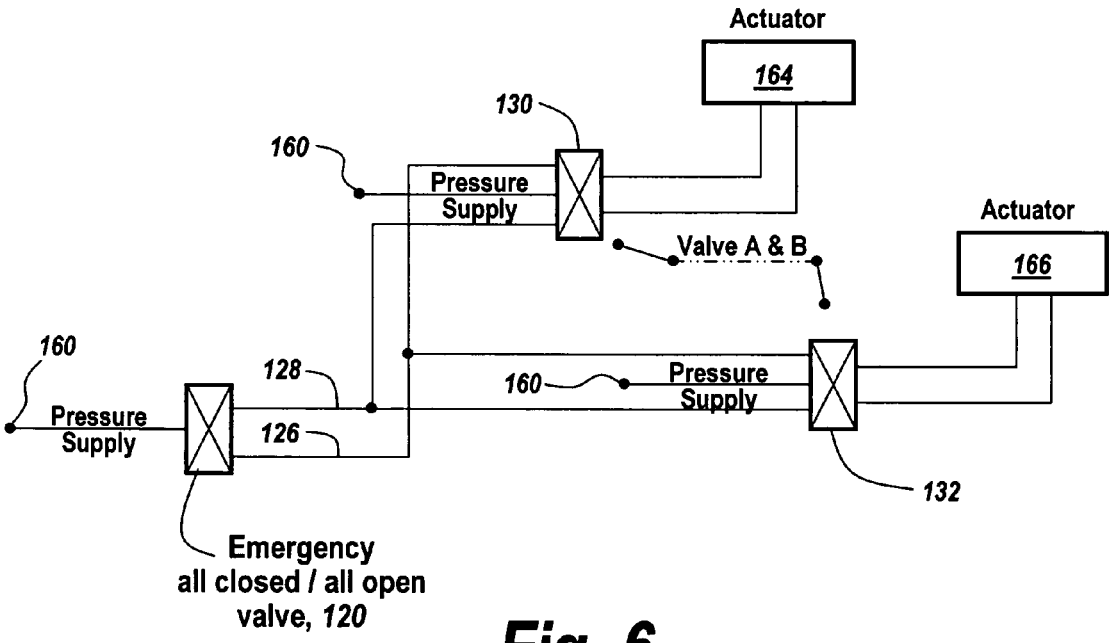

Referring now to FIG. 6, the parallel connection of the emergency all closed/all open valve 120 is shown coupled to a pressure supply 160. As can be seen, lines 126 and 128 are routed to the respective inlet ports of control valves 130 and 132, each also supplied from pressure supply 160. These two inlet lines are then coupled by the indicated valves to respective actuators 164 and 166 and seacocks.

Since these are momentary actuation valves, the pulses of pressure are only momentarily delivered to open or close the seacocks through the momentary action. If there are no control pulses from valve 120, then valves 130 and 132 operate in the normal fashion.

While the present invention has been described in connection with the preferred embodiments of the various Figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. Apparatus for closing of all or selected seacocks in a vessel, comprising:

a number of seacocks adapted to be coupled to different pieces of apparatus for which sea water is utilized in the piece of apparatus or in which the piece of apparatus vents through a seacock, each of said seacocks having a rotatable valve stem for opening and closing the associated seacock;

a pneumatic rotary actuator for each of said seacock valve stems for rotating the associated seacock valve stem from an open to a closed position or from a closed to an open position;

a source of pneumatic pressure;

a pneumatic control circuit coupled between said pneumatic pressure source and each of said actuators, said control panel having at least one all on/all off valve for actuating all of said rotary actuators in accordance with the position of said all on/all off valve, such that all said seacocks may be closed or opened in accordance with the position of said all on/all off valve.

2. The apparatus of claim 1, and further including for each seacock a separate control valve connected between said pneumatic pressure source and the associated seacock for opening or closing the associated seacock in accordance with the position of said separate valve.

3. The apparatus of claim 2, wherein said all on/all off control valve is coupled in parallel with said separate control valves.

4. The apparatus of claim 3, wherein the operation of said all off/all on control valve overrides the action of said separate control valves.

5. The apparatus of claim 4, wherein all said valves are momentary action valves providing a pulse of pneumatic pressure to associated actuators, after which time said valves move to a neutral position leaving the associated actuators free to move after pneumatic actuation.

6. The apparatus of claim 5, wherein the state of a seacock is sensed and further including an indicator for each of said seacocks indicating the state of the associated seacock, whereby the state of an associated seacock can be ascertained.

7. The apparatus of claim 6, wherein said indicators are located adjacent corresponding separate control valves.

8. The apparatus of claim 2 wherein each of said valves is a momentary actuating valve for applying a pulse of pressure to the associated rotary actuator for the movement of said rotary actuator, each momentary actuation valve removing all pressure from the rotary actuator after momentary actuation, thereby to permit associated rotary actuators to be further actuated by the associated separate individual control valve.

9. The apparatus of claim 8, wherein at least one of said valve stems includes a handle for manually opening or closing the associated seacock, said handle being effective to open or close the associated seacock since the associated rotary actuator is free to move after the initial application of a pulse of pneumatic fluid, thereby to provide a manual override.

10. The apparatus of claim 1, and further including a retrofit kit for retrofitting each of said seacocks with an associated rotary actuator.

11. The apparatus of claim 10, wherein said retrofit includes a bracket bolted to the associated seacock for mounting the associated rotary actuator in proximity to the associated seacock.

12. The apparatus of claim 11, wherein each of said rotary actuators includes a rotary shaft and further including an adapter between said rotary shaft and the associated seacock valve stem.

13. The apparatus of claim 1, wherein said pneumatic pressure source includes a charged reservoir having sufficient pneumatic fluid to accuate all of said rotary actuators and wherein each of said rotary actuators is caused to move with a pulse of fluid from said pneumatic pressure source, said rotary actuators maintaining the rotary position associated with the pulse of pneumatic fluid after the pneumatic pressure is removed from the rotary actuator.

14. The apparatus of claim 13, wherein each of said rotary actuators includes a rack and pinion, said pulse of pneumatic pressure being applied to an end of a rack to move the rack in a predetermined direction, thus to rotate the associated pinion in a predetermined direction.

15. The apparatus of claim 14, and further including a pneumatic pulse applied to an opposite end of said rack to move said pinion in an opposite direction.

16. The apparatus of claim 15, and further including internal stops in each of said rotary actuators for limiting the movement of the associated pinions.

17. The apparatus of claim 1, wherein no external source of power is required to actuate said rotary actuators other than the pressure provided by said pneumatic pressure source, thereby to provide a fail safe system for closing all of said seacocks.

18. A method for automatically closing all of the seacocks in a vessel without the use of electric or hydraulic power, comprising:

providing a source of prepressurized pneumatic fluid;

providing a pneumatic rotary actuator for each of said seacocks, each of said rotary actuators being actuated by a momentary pulse of pneumatic fluid coupled to the associated rotary actuator for opening or closing the associated seacock; and, providing an all on/all off control valve between the pneumatic pressure source and each rotary actuator such that all of the seacocks may be moved to a closed position with a pulse of pneumatic fluid controlled by the all on/all off valve, whereby all seacocks can be closed regardless of availability of electrical power and regardless of there being no constantly running pump.

19. A method of claim 18, and further including providing for each rotary actuator a separate control valve between the pressurized pneumatic fluid source and the actuator with the separate control valves connected in parallel with the all on/all off control valve.

20. The method of claim 19, wherein all of the control valves are momentary actuation valves having a lever which is moved from one side to the other to provide a pulse of pneumatic fluid and where the lever is returned to a neutral position to remove any pneumatic pressure from an actuator, whereby after a rotary actuator is initially actuated by a pulse of pneumatic fluid it may be subsequently actuated either manually or by a subsequent pneumatic fluid pulse provided under the control of an associated control valve, whereby if all of the seacocks are closed through the actuation of the all on/all off control valve, selected seacocks may be opened either manually or through the action of an associated separate control valve.

21. The method of claim 18, wherein the all on/all off control valve may be used to open all of the associated seacocks regardless of any initial closed or open position.

* * * * *